US006494436B1

(12) United States Patent
Hopps

(10) Patent No.: US 6,494,436 B1
(45) Date of Patent: Dec. 17, 2002

(54) WIRE TENSIONING TOOL

(75) Inventor: Michael William Hopps, Crowborough (GB)

(73) Assignee: Draper Tools Limited, Hampshire (GB)

( * ) Notice: Subject to any disclaimer, the term of this patent is extended or adjusted under 35 U.S.C. 154(b) by 0 days.

(21) Appl. No.: 09/701,526

(22) PCT Filed: May 27, 1999

(86) PCT No.: PCT/GB99/01672

§ 371 (c)(1),
(2), (4) Date: Jan. 17, 2001

(87) PCT Pub. No.: WO99/61208

PCT Pub. Date: Dec. 2, 1999

(30) Foreign Application Priority Data

May 28, 1998 (GB) ..... 9811329

(51) Int. Cl.[7] ..... B21F 9/00; B25B 25/00; B66F 3/00

(52) U.S. Cl. ..... 254/245; 254/250; 254/251; 254/252; 254/261

(58) Field of Search ..... 254/243, 245, 254/250, 251, 252, 254, 256, 261

(56) References Cited

U.S. PATENT DOCUMENTS

| | | | | | |
|---|---|---|---|---|---|
| 379,669 | A | * | 3/1888 | Warren | 254/243 |
| 513,816 | A | * | 1/1894 | Negus | 254/251 |
| 518,672 | A | * | 4/1894 | Merritt | 254/243 |
| 763,549 | A | * | 6/1904 | Ferguson et al. | 254/251 |
| 773,099 | A | * | 9/1904 | Schwien | 254/252 |
| 793,090 | A | * | 6/1905 | Payne | 254/243 |
| 1,289,252 | A | * | 12/1918 | Payne | 254/251 |
| 1,545,325 | A | * | 7/1925 | Hess | 254/251 |
| 1,555,367 | A | * | 9/1925 | Hall | 254/251 |
| 1,922,706 | A | * | 8/1933 | Neptune | 254/251 |
| 1,930,005 | A | * | 10/1933 | Forsythe | 254/243 |
| 2,154,762 | A | * | 4/1939 | Mcgregor et al. | 254/243 |
| 2,598,553 | A | * | 5/1952 | Jennings | 254/250 |
| 2,723,103 | A | * | 11/1955 | Glassmaker | 254/261 |
| 2,732,175 | A | * | 1/1956 | Mount | 254/243 |
| 3,655,165 | A | * | 4/1972 | Wright | 254/251 |
| 3,990,682 | A | * | 11/1976 | Bersaw | 254/251 |

FOREIGN PATENT DOCUMENTS

| | | | | |
|---|---|---|---|---|
| CH | 93355 | | 2/1921 | |
| DE | 410405 | * | 3/1925 | 254/243 |
| GB | 424085 | | 2/1935 | |
| GB | 691369 | | 5/1953 | |
| GB | 757458 | | 9/1956 | |
| GB | 1045867 | | 10/1966 | |
| GB | 2185080 | | 7/1987 | |
| WO | WO 84/04732 | | 12/1984 | |

* cited by examiner

*Primary Examiner*—Emmanuel Marcelo
(74) *Attorney, Agent, or Firm*—RatnerPrestia

(57) ABSTRACT

A fence wire tensioning tool includes an arm 2 with fixed jaws 7 attached to both sides and a positioning foot 4 which pivots about a bolt 8. At the opposite end of the arm is fixed a movable jaw assembly 1, which extends to form a handle 3. This assembly rotates about a pivot pin 5, which is secured by a hexagonal socket set screw 10. The handle 3 may include a rubber or plastic hand grip 12 which affords a better purchase on the tool by the operator.

26 Claims, 2 Drawing Sheets

WIRE TENSIONING TOOL

BACKGROUND OF THE INVENTION

This invention relates to a hand operated fence wire tensioning tool which can be used with all types of fence wire and in association with a variety of different size and types of fence post.

SUMMARY OF THE INVENTION

A number of different fence wire tensioning devices exist but these usually rely upon a separate linkage to a straining post or second fixed anchor point, whilst operating with serrated jaws to achieve a gripping effect. Such devices are often heavy, cumbersome in operation, time consuming to set up and use—and they invariably damage the plastic coating or metal plating that is applied to the fence wire to prevent rusting and deterioration.

A wire tensioning device is disclosed in GB-A-2185080 comprising a head for engaging a post to which wire is to be attached and an elongate lever member. The head is pivotally connected to the lever member. The head and lever member having surfaces which define a reducible area for receiving the wire. The lever is lent on to trap the wire in the reducible area and to tension the wire about the post.

A problem encountered with such prior art tools is that the head is formed with a curved and pointed surface for engaging a post. As the wire is stretched the head either slides round the post or, the head pivots on a progressively smaller point of contact. Thus as the tension in the wire increases the tool becomes progressively more unstable as the head moves away from the post.

An object of this invention is to provide a simple and effective means of tensioning fence wires before stapling in the usual way—especially when an operative is working alone and without mechanical aids such as a tractor, ratchet device or pulley system; or more particularly when working in a restricted, sloping or uneven working position where such devices may be difficult or unsafe to operate. It is a further object to overcome the aforementioned problem with the prior art.

Accordingly the invention provides a fence wire tensioning tool comprising a pivoting foot for engaging a fence post, a handle member including a first jaw surface, the handle member being pivotally attached to an intermediate arm member carrying a second jaw surface opposing said first jaw surface to provide jaws for gripping a fence wire, the pivoting foot member being pivotally attached to said intermediate arm member, whereby when the jaws are closed on a wire the intermediate arm member and the handle provide a lever pivoting about the pivot point of the pivoting foot. The foot bearing on a fence post provides a constant bearing surface so that the stability of the tool is improved as the amount of tension applied to the wire increases.

The pivoting foot may have an arcuate bearing surface. The bearing surface may be serrated, ribbed, denticulate or covered with a friction type material. The gripping section may be made of Durbar (RTM) or similar sheet or plate material which offers a pre-formed surface texture. The radius of the bearing surface is dependent on the size of fence post on which it is intended to be used. The bearing surface radius may be in the range 40 to 100, preferably 60 to 80 mm. The bearing surface radius may be 75 mm.

The leverage applied to the handle effects a class 2 lever acting against the pivot point of the positioning foot.

Simultaneously, a double class 1 lever action is effected on the wire held between the jaws. The arrangement allows a single handed action.

The wire is gripped by said jaws, which may engage by means of an eccentric cam action. This arrangement reduces the damage to the surface of the wire as the force on the wire is distributed evenly across the jaws to reduce the risk of the wire being cut or distorted by point contact and preventing slippage.

Each of said intermediate arm member and said handle may include pairs of said first and second opposing jaw surfaces. The jaws on both sides of the tool allow both left handed and right handed operation of the tool.

The wire tensioning tool may comprise a resilient means associated with the handle and acting against the leverage applied to the handle. The resilient means may conveniently be a compression spring. It has been found that the presence of the resilient means assists in opening the jaws once a wire has been put in place.

The handle may be provided with a rubber or plastic friction handgrip. The handle may be attached to a jaw assembly by swaging. Alternatively the handle is attached by means of welding, brazing, a screw thread, rivets, socket or force fit to. spigot.

The wire tensioning tool may be made from metal, plastics material, rubber, or from a combination of these and other suitable materials. Preferably the fence wire tensioning tool is made out of metal but certain parts of it may instead be constructed from modem materials such as carbon fibre or certain plastics, which offer advantages for ease of manufacture or weight reduction without compromising the necessary leverage required to operate successfully.

A fence wire tensioning tool including a handle and fixed and movable jaws and a pivoting foot or other similar device which can be positioned against or effect a means to engage a fence post for the purpose of tensioning fence wires prior to stapling in the usual way is provided.

The tool of the invention may be advantageously used for all purposes where it is desired to tension wires and may be particularly useful in the agricultural, horticultural and construction industries. The tool may also be sold via the DIY trade.

BRIEF DESCRIPTION OF THE DRAWINGS

The invention will now be described in more detail, and by way of example only, with reference to the accompanying drawings in which.

DETAILED DESCRIPTION OF THE INVENTION

Figure 1:
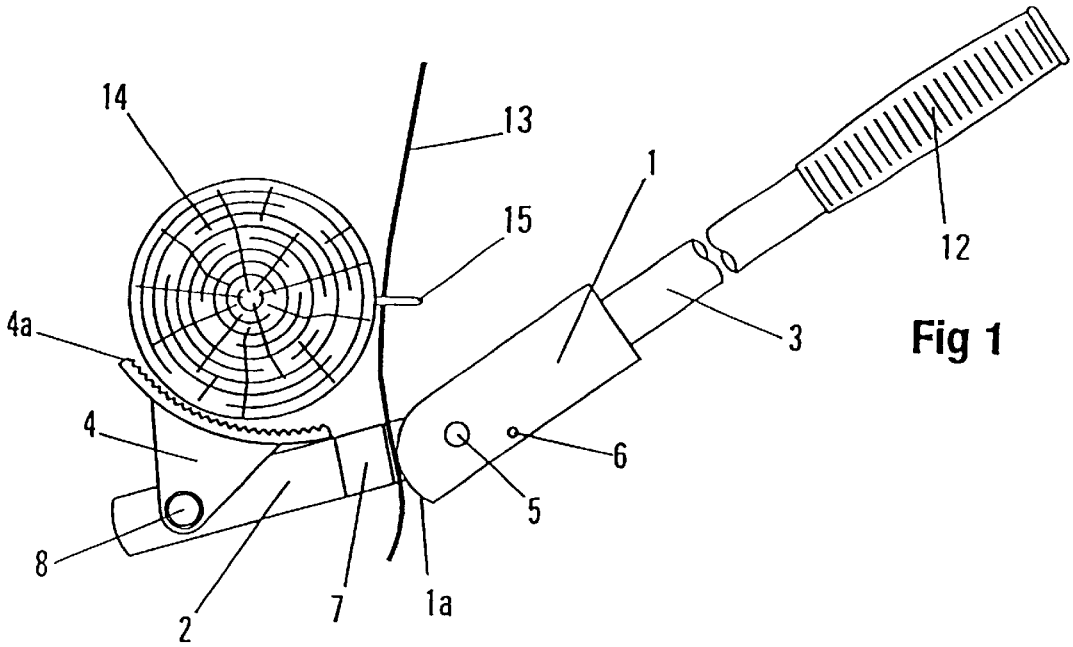
FIG. 1 shows a plan view of the fence post and wire, with the tool in position before a wire is tensioned.

Referring to FIG. 1, the fence wire tensioning tool comprises an arm 2 with fixed jaw surfaces 7 attached to both sides. The fixed jaw surfaces 7 are arranged at an angle to the axis of the arm 2. In this embodiment, the jaw surfaces are at an angle of 20° to the normal of the longitudinal axis of the arm 2. The fixed jaw surfaces 7 may have surfaces that are rounded at least at the leading edge. Also attached to the arm 2 is a positioning foot 4. The positioning foot 4 is secured to the arm by a bolt 8 and a self-locking nut 9. The positioning foot 4 is located proximate one end of the arm 2 and pivots about the bolt 8. The positioning foot 4 has an arcuate bearing surface 4*a*. The radius of the bearing surface 4*a* is about 75 mm.

At the opposite end of the arm 2 is a movable jaw assembly 1 which extends to form a handle 3 to which is attached a rubber or plastic friction handgrip 12. The assembly 1 pivots about a pin 5, which is secured to the arm 2 by a hexagonal socket set screw 10. The jaw assembly 1 has a pair of arcuate jaw surfaces 1*a* opposing the pair of fixed jaw surfaces 7.

Figure 2:
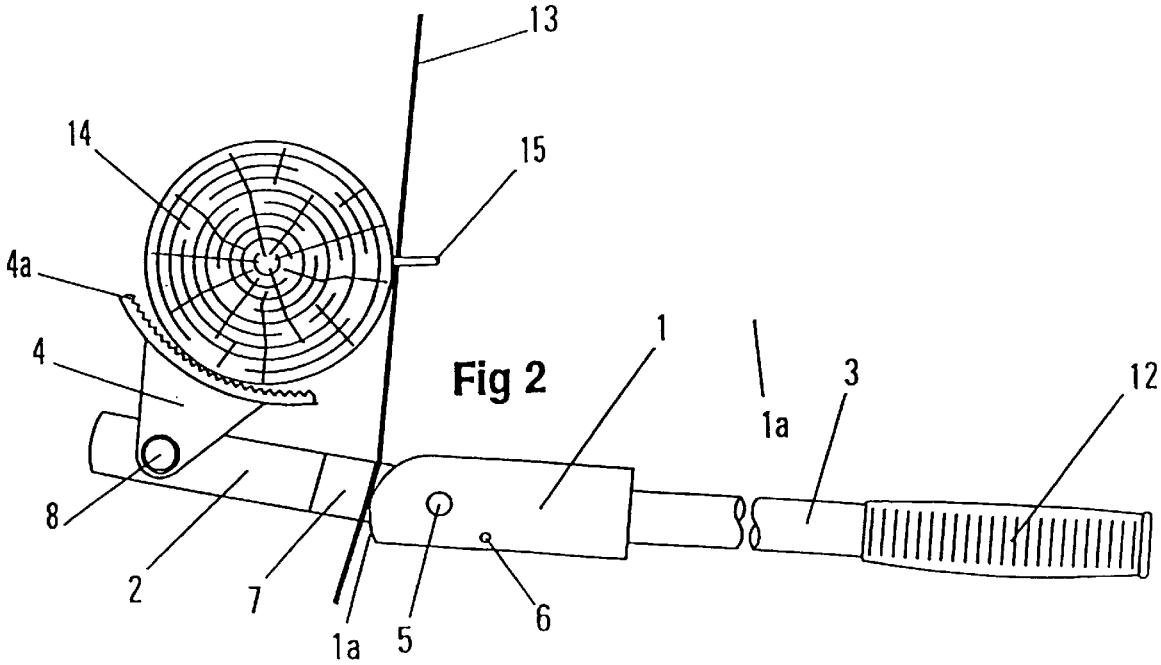
FIG. 2 shows a plan view of the tool and a fence post with the wire in tension after leverage has been applied to the handle and jaws have engaged the fence wire.
Figure 3:
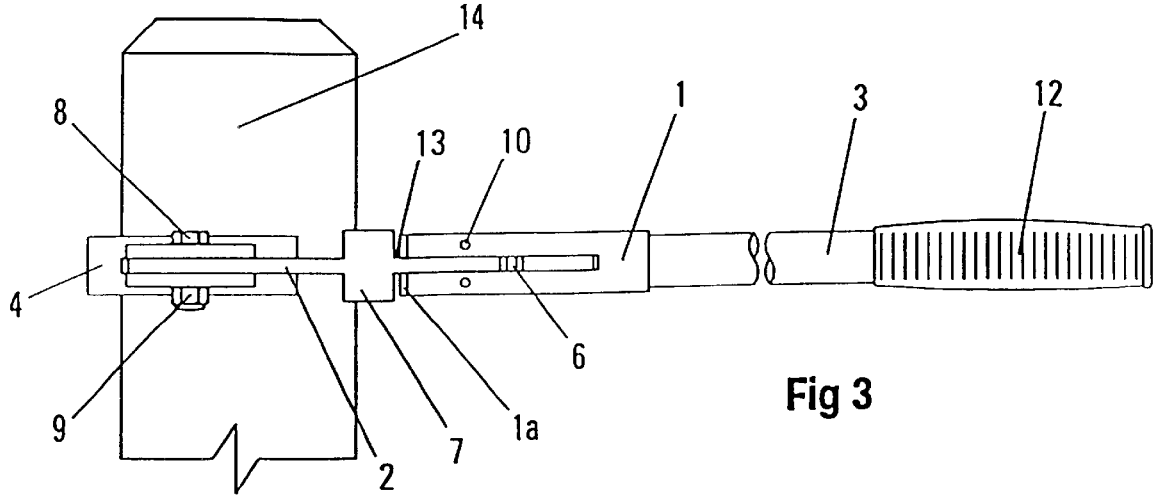
FIG. 3 shows a front elevation of the tool and a fence post with the wire shown engaged between the jaws.

As shown in FIGS. 2 and 3, the pivot pin 5 allows the movable jaw assembly 1 to turn about the arm 2, so engaging the fence wire 13 with the fixed jaw surface 7 by means of an eccentric cam action. The eccentric cam action is achieved by positioning the pin 5 offset from the centre of curvature of the jaw surfaces 1*a*.

Figure 4:
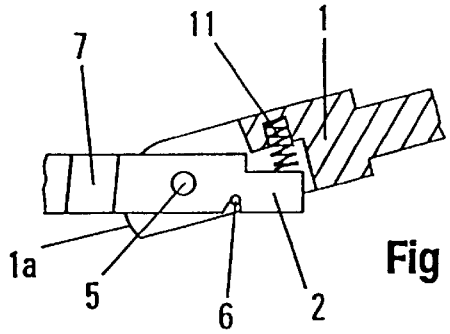
FIG. 4 shows a partial view of a movable jaw assembly in section and indicates the position of a return compression spring and movement limiting pin.

As shown in FIG. 4, a compression spring 11 is retained within a blind hole of the movable jaw assembly 1. The spring 11 opposes the rotational movement of the fixed jaw surface 7 and movable jaw assembly 1 and assists in releasing the grip on the fence wire when pressure on the handle 3 is removed. A movement limiting pin 6 engages in a tapered housing in the arm 2 to prevent excessive opening of the fixed and movable jaws 1*a,* 7 when locating the tool on the wire 13.

In use, the positioning foot 4 of the tool is placed against the fence post 14 in the manner shown in FIG. 1. In this position the foot 4 is pivoted towards the fixed and moveable jaws. The jaws 1*a,* 7 are in their open position with further pivoting of the handle 3 prevented by the pin 6. A fence wire 13, secured to a preceding post, is located between the jaws 1*a,* 7 and leverage applied to the handle 3 pivots the handle 3 about pin 5 causing the jaws 1*a,* 7 to close, gripping the wire 13. As soon as the wire 13 is locked in place by the pressure exerted between the jaws 1*a,* 7, the force generated by leverage applied to the handle 3 is transferred to the bolt 8 of the positioning foot 4. The bolt 8 acts as a pivot and the action effects a class 2, lever action between the post 14 and the handle 3, which in turn stretches the wire 13.

Thus as the wire 13 is stretched the proportion of the bearing surface 4*a* in contact with the fence post 14 is constant. The bearing surface 4*a* is formed by a pre-ribbed gripping section that is pressed into shape before welding. The presence of a gripping section on the bearing surface 4*a* coupled with the pressure exerted on the foot 4 towards the fence post 14 reduces the tendency of the foot 4 to slide around the post 14 as the arm 2 pivots about the bolt 8. Still further, the wire 13 is pulled advantageously towards the post 14 as the tool is levered around the bolt 8. The bearing surface radius of 75 mm is suitable for most diameters of fence post and is large enough for the maximum size of fence post likely to be encountered.

The eccentric cam locking action of the jaw assembly 1 eliminates slippage and consequential damage to the surface of the fence wire 13. Even in unfavourable conditions the configuration ensures that whatever pressure is being applied against the fence post 14 by the leverage of the handle 3, so a correspondingly greater pressure is applied between the jaws 1*a,* 7.

Once the tool has been employed, tension on the fence wire is effectively maintained by a single handed movement on the handle 3 while the wire staple 15 is hammered into the post 14 in the usual manner. The operation is then repeated at each post along the fence.

The opposing sets of jaws 1*a,* 7 allow for either left or right handed operation of the tool from above or below the wire 13 and from either side of the fence line if working in restricted or difficult locations.

The distance between the two pivot points (i.e. from bolt 8 to pin 5) is about 110 mm which may be varied depending on the dimensions of the whole tool. The distance between the fixed jaw surfaces 7 and the pivot point of the positioning foot is about 85 mm (+–5 mm). The distance between the bearing surface 4*a* and the pivot point of the positioning foot 4 is suitable 40 mm (+–5 mm) taken along the line through the centre of curvature of the bearing surface 4*a*. The angle of the fixed jaw surface to the normal to the longitudinal axis of the arm 2 may vary by +–2.5°. It is important to the stability of the device that the dimensions chosen, especially for the bearing surface to pivot distance and the pivot to jaw surface distance, result in the position of the jaws when the tool is located on a fence post being approximately in line with the line of the fence or wire suspended between the present post and the preceding post. The dimensions given above are for a tool suitable for use up to a maximum post size of about 150 to 200 mm. The fixed jaw angle allows the jaws to be lined up substantially with the lay of the wire so that the tool is in the correct position as it is offered to the post. Only minimum movement of the handle is required to lock the wire in place before pressure on the handle is transferred to the post via the foot.

Whilst an embodiment of the invention has been described with reference to the accompanying drawings, modifications and variations will suggest themselves to those skilled in the art without departing from the scope of the invention as defined in the appended claims. The bolt 8 and pin 5 may be replaced with any equivalent means such as rivets, or a pin or bolt as appropriate. The end of the handle or the arm member may include a hook (not shown) by which the tool can be conveniently hung on a suspended wire when the tool is not in use. The tool may be provided with interchangeable positioning feet having different radius bearing surfaces and/ or providing different distances between the bearing surface and the pivot point. Furthermore, the intermediate arm member may be adjustable so as to increase or decrease the pivot to jaw face distance allowing adjustment for different post sizes.

Whilst in the embodiment described a movement limiting pin is used to limit the rotational movement of the handle relative to the arm, the arm could sit in a cavity of the handle such that walls of the handle enclosing the arm prevent rotational movement beyond a certain limited amount in either direction. It is sufficient for the handle to pivot sufficiently to open and close the jaws.

I claim:

1. A fence wire tensioning tool comprising a handle (3) including a first jaw surface (1*a*), the handle member being pivotally attached to an intermediate arm member (2) carrying a second jaw surface (7) opposing said first jaw surface characterized in that said first and second jaw surfaces provide jaws for gripping a fence wire, and a pivoting positioning foot (4) comprising a bearing surface (4*a*) adapted to abut against a fence post when said tool is pressed against said fence post for engaging a fence post, the positioning foot (4) being pivotally attached to said intermediate arm member (2) at a pivot point, whereby when the jaws (1*a,* 7) are closed on a fence wire the intermediate arm member (2) and the handle (3) provide a lever pivoting about the pivot point of the pivoting foot (4).

2. A fence wire tensioning tool as claimed in claim 1, wherein said positioning foot (4) has a bearing surface with one of a serrated, ribbed, denticulate and friction type material covered surface.

3. A fence wire tensioning tool as claimed in claim 2, wherein leverage applied to the handle (3) effects a class 2 lever action between the pivot point of the positioning foot and the jaws (1*a,* 7).

4. A fence wire tensioning tool as claimed in any claim 3, comprising a resilient means (11) associated with the handle (3) and acting against the leverage applied to the handle.

5. A fence wire tensioning tool as claimed in claim 2, wherein the wire is gripped by said jaws (1*a,* 7) which engage by means of an eccentric cam action.

6. A fence wire tensioning tool as claimed in claim 5, wherein said intermediate arm member and said handle member each include a first and an opposite second side, said first and said second jaw surfaces are located on said first side of said arm member and said handle member respectively, and wherein said tool further comprises third and fourth jaw surfaces located on said second side of said arm member and said handle member respectively, substantially opposite said first and said second jaw surfaces thereby allowing both right and left handed operation of said tool.

7. A fence wire tensioning tool as claimed in claim 6, comprising a resilient means (11) associated with the handle (3) and acting against the leverage applied to the handle.

8. A fence wire tensioning tool as claimed in claim 5, comprising a resilient means (11) associated with the handle (3) and acting against the leverage applied to the handle.

9. A fence wire tensioning tool as claimed in claim 2, comprising a resilient means (11) associated with the handle (3) and acting against the leverage applied to the handle.

10. A fence wire tensioning tool as claimed in claim 1, wherein leverage applied to the handle (3) effects a double lever action between the pivot point of the positioning foot and the jaws (1*a,* 7).

11. A fence wire tensioning tool as claimed in claim 10, wherein the wire is gripped by said jaws (1*a,* 7) which engage by means of an eccentric cam action.

12. A fence wire tensioning tool as claimed in claim 11, wherein said intermediate arm member and said handle member each include a first and an opposite second side, said first and said second jaw surfaces are located on said first side of said arm member and said handle member respectively, and wherein said tool further comprises third and fourth jaw surfaces located on said second side of said arm member and said handle member respectively, substantially opposite said first and said second jaw surfaces thereby allowing both right and left handed operation of said tool.

13. A fence wire tensioning tool as claimed in claim 12, comprising a resilient means (11) associated with the handle (3) and acting against the leverage applied to the handle.

14. A fence wire tensioning tool as claimed in claim 11, comprising a resilient means (11) associated with the handle (3) and acting against the leverage applied to the handle.

15. A fence wire tensioning tool as claimed in claim 10, comprising a resilient means (11) associated with the handle (3) and acting against the leverage applied to the handle.

16. A fence wire tensioning tool as claimed in claim 1, wherein the wire is gripped by said jaws (1*a,* 7) which engage by means of an eccentric cam action.

17. A fence wire tensioning tool as claimed in claim 16, wherein said intermediate arm member and said handle member each include a first and an opposite second side, said first and said second jaw surfaces are located on said first side of said arm member and said handle member respectively, and wherein said tool further comprises third and fourth jaw surfaces located on said second side of said arm member and said handle member respectively, substantially opposite said first and said second jaw surfaces thereby allowing both right and left handed operation of said tool.

18. A fence wire tensioning tool as claimed in claim 17, comprising a resilient means (11) associated with the handle (3) and acting against the leverage applied to the handle.

19. A fence wire tensioning tool as claimed in claim 16, comprising a resilient means (11) associated with the handle (3) and acting against the leverage applied to the handle.

20. A fence wire tensioning tool as claimed in claim 1, comprising a resilient means (11) associated with the handle (3) and acting against the leverage applied to the handle.

21. A method for tensioning and attaching a fence wire to a fence post using a fence wire tensioning tool comprising a handle (3) a positioning foot (4) and an intermediate arm member (2) between said handle and said foot pivotally connected to said handle and to said to said foot through a handle pivot, and a foot pivot respectively, the handle including a first jaw surface (1*a*), the intermediate arm member (2) carrying a second jaw surface (7) opposing said first jaw surface to provide jaws for gripping a fence wire, the positioning foot (4) comprising a bearing surface (4a) adapted to abut against a fence post when said tool is pressed against said fence post, wherein when the jaws (1*a,* 7) are closed on a wire the intermediate arm member (2) and the handle (3) provide a lever pivoting about the foot pivot point, the method comprising:

abutting the bearing surface (4*a*) of said foot (4) of the tool against said fence post and positioning said fence wire in said jaws for gripping said fence wire;

pivoting said handle about said handle pivot point to close said jaws and grip said wire in said jaws;

continuing pivoting said handle to stretch said wire; and while holding said handle pivoted and maintaining said wire stretched, attaching said wire to said post.

22. The method according to claim 21 wherein said handle is pivoted by an operator using one hand.

23. The method according to claim 22 wherein said operator uses another hand to attach said wire to said post with a wire staple.

24. A fence wire tensioning tool comprising:

(a) an elongated handle member, (b) a positioning foot member comprising a first pivot and an arcuate abutting surface spaced from said pivot, and (c) an intermediate member between said foot member and said elongated handle;

wherein said intermediate member is pivotally connected to said foot member through said first pivot and to said elongated handle through a second pivot; and wherein said intermediate member further comprises a first jaw surface and said elongated handle comprises a second jaw surface, said second jaw surface located opposite said first jaw surface, said first and said second jaw surfaces cooperating to grip a wire placed therein-between when said handle pivots around said second pivot.

25. The wire tensioning tool according to claim 24 further comprising a limiting pin to limit an arc through which the intermediate member swings around said second pivot relative to said handle.

26. The wire tensioning tool according to claim 25 further comprising a spring cooperating with said intermediate arm and said elongated handle to urge said intermediate arm relative to said elongated handle to said limit of said arc defined by said limiting pin.

* * * * *